US008836682B2

(12) United States Patent
Hong

(10) Patent No.: US 8,836,682 B2
(45) Date of Patent: Sep. 16, 2014

(54) FLAT PANEL DISPLAY DEVICE AND SOURCE DRIVER CIRCUIT FOR PERFORMING MUTIPLE DRIVING OPERATIONS WITHIN A UNIT SOURCING PERIOD

(75) Inventor: Soon Woon Hong, Seoul (KR)

(73) Assignee: TLI Inc., Seongnam-Si, Gyeonggi-Do (KR)

( * ) Notice: Subject to any disclaimer, the term of this patent is extended or adjusted under 35 U.S.C. 154(b) by 1018 days.

(21) Appl. No.: 12/699,364

(22) Filed: Feb. 3, 2010

(65) Prior Publication Data

US 2010/0225631 A1 Sep. 9, 2010

(30) Foreign Application Priority Data

Mar. 6, 2009 (KR) ..... 10-2009-0019101

(51) Int. Cl.
*G09G 3/20* (2006.01)

(52) U.S. Cl.
CPC ..... *G09G 3/20* (2013.01); *G09G 2310/0297* (2013.01); *G09G 2310/0275* (2013.01)
USPC ..... 345/211

(58) Field of Classification Search
CPC ... G06F 3/038; G09G 3/20; G09G 2310/0297
USPC ..... 345/211, 84
See application file for complete search history.

(56) References Cited

U.S. PATENT DOCUMENTS

2002/0163490 A1* 11/2002 Nose ..... 345/89
2004/0036706 A1* 2/2004 Endou ..... 345/690
2004/0227710 A1* 11/2004 Shimizu et al. ..... 345/87

FOREIGN PATENT DOCUMENTS

KR 1020040052349 A 6/2004
KR 1020040052357 A 6/2004
KR 1020040060708 A 7/2004
KR 100835145 B1 5/2008

* cited by examiner

*Primary Examiner* — William Boddie
*Assistant Examiner* — Towfiq Elahi
(74) *Attorney, Agent, or Firm* — Kile Park Reed & Houtteman PLLC

(57) ABSTRACT

A flat panel display device and a source driver circuit for the flat panel display device are provided for performing multiple driving operations within a unit sourcing period. In the flat panel display device, multiple driving operations are performed within the unit sourcing period, and source voltages are supplied to a selected number of data lines in each driving operation. In this case, one DAC is driven to generate source voltages for a plurality of data lines. In the flat panel display device, the number of the DACs is reduced and the overall layout area is greatly reduced. Also, standby power consumption can be greatly reduced due to the reduced number of amplifiers. Since the source voltages provided by the same amplifier are provided to adjacent data lines, a metal layer can be easily wired in the display panel.

12 Claims, 11 Drawing Sheets

| Output / Operation | TU1 | TU2 | TU3 |
|---|---|---|---|
| P-FDR | R | B | G |
| P-SDR | G | R | B |

FIG. 5

| Data line | DL1 | DL2 | DL3 | DL4 | DL5 | DL6 |
|---|---|---|---|---|---|---|
| Image signal | R | G | B | R | G | B |

FIG. 7

| Output / Operation | TU1 | TU2 | TU3 |
|---|---|---|---|
| P-FDR | R | B | G |
| P-SDR | G | R | B |
| P-TDR | B | G | R |

FIG. 9

| Data line | DL1 | DL2 | DL3 | DL4 | DL5 | DL6 | DL7 | DL8 | DL9 |
|---|---|---|---|---|---|---|---|---|---|
| Image signal | R | G | B | R | G | B | R | G | B |

FIG. 11

FLAT PANEL DISPLAY DEVICE AND SOURCE DRIVER CIRCUIT FOR PERFORMING MUTIPLE DRIVING OPERATIONS WITHIN A UNIT SOURCING PERIOD

CROSS-REFERENCE TO RELATED APPLICATION

This application claims the benefit of Korean Patent Application No. 10-2009-0019101, filed on Mar. 6, 2009, the contents of which are hereby incorporated herein by reference in their entirety.

BACKGROUND

1. Field

The present invention relates to a flat panel display device and a source driver circuit for the flat panel display device, and more particularly, to a flat panel display device (FPD) having a digital-to-analog converter (DAC) using separately provided R, G, and B group gradation voltages, and a source driver circuit for the flat panel display device.

2. Description of the Related Art

Recently, various flat panel display devices having a smaller weight and volume than a cathode ray tube (CRT) are being developed. Examples of flat panel display devices include liquid crystal display devices, field emission display devices, plasma display devices, light emitting diodes (LEDs) and organic light emitting diodes (OLEDs).

In general, a flat panel display device includes a display panel, a gate driver circuit and a source driver circuit. The gate driver circuit generates sequentially activated gate signals to sequentially select gate lines of the display panel. The source driver circuit provides source voltages to data lines of the display panel. In this case, the source voltages provided to the data lines have voltage levels corresponding to digital data. Three source voltages generally constitute one set and are provided as R, G, and B image signals to the data lines. In other words, three data lines constitute one set and are driven by the source voltages as R, G, and B image signals.

Meanwhile, the source driver circuit employs digital-to-analog converters (DACs) to generate the source voltages ultimately serving as the R, G, and B image signals, in which group gradation voltages are applied to the DACs. In a specific flat panel display device, the DAC requires separately provided R, G, and B group gradation voltages.

FIG. 1 is a block diagram of a source driver circuit in a conventional flat panel display device using separately provided R, G, and B-group gradation voltages.

A display panel generally includes a number of data lines, such as 512 data lines or 1024 data lines. For convenience of illustration, only six data lines DL1 to DL6 are shown in FIG. 1. For clarity of the illustration, only a data supply unit 10, a digital-to-analog conversion unit 20 and a driving unit 30 among components of the source driver circuit are shown in FIG. 1 and other components and control signals are omitted.

Referring to FIG. 1, respective registers 11 to 16 in the data supply unit 10 provide digital data DGT1 to DGT6 of corresponding data lines DL1 to DL6 to corresponding DACs 21 to 26 of the digital-to-analog conversion unit 20. The DACs 21 to 26 convert the digital data DGT1 to DGT6 to analog data ALT1 to ALT6, respectively. In this case, R, G, and B-group gradation voltages R-VSCL, G-VSCL, and B-VSCL are applied to every three of the DACs 21 to 26 in the digital-to-analog conversion unit 20. In FIG. 1, the R-group gradation voltages R-VSCL are applied to the first and fourth DACs 21 and 24, the G-group gradation voltages G-VSCL are applied to the second and fifth DACs 22 and 25, and the B-group gradation voltages B-VSCL are applied to the third and sixth DACs 23 and 26. In the driving unit 30, amplifiers 31 to 36 amplify and output the analog data ALT1 to ALT6. Outputs of the amplifiers 31 to 36 are provided as the source voltages VSC1 to VSC6 to the corresponding data lines DL1 to DL6 at substantially the same timing, as shown in FIG. 2. In FIG. 2, a unit sourcing period refers to a timing period in which source voltages are provided once to all the data lines of the display panel.

However, in the source driver circuit of the conventional flat panel display device as shown in FIG. 1, a DAC is disposed on each data line. That is, one DAC is disposed on one data line. Here, when a bit number of the digital data is 8, a greater number of transistors are required to embody one DAC. Accordingly, a conventional source driver circuit and a flat panel display device employing the source driver circuit require a very large layout area for DACs.

Thus, there is a need for a flat panel display device requiring a small layout area due to a small number of DACs disposed on each data line, and a source driver circuit for the flat panel display device.

SUMMARY OF THE INVENTION

The present invention is directed to a flat panel display device requiring a small layout area due to a smaller number of DACs using separately provided R, G, and B-group gradation voltages and disposed on each data line, and a source driver circuit for the flat panel display device.

According to an aspect of the present invention, there is provided a source driver circuit including a plurality of source driving blocks. Each of the source driving blocks includes: a data supply unit for supplying α-digital data, β-digital data and γ-digital data; a digital-to-analog conversion unit including a first digital-to-analog converter (DAC) for receiving α-group gradation voltages, a second DAC for receiving β-group gradation voltages, and a third DAC for receiving γ-group gradation voltages, the first to third DACs receiving the α-digital data, the β-digital data and the γ-digital data and outputting α-analog data, β-analog data and γ-analog data having the α-group gradation voltage, the β-group gradation voltage and the γ-group gradation voltage corresponding to the α-digital data, the β-digital data and the γ-digital data; and a driving unit including first to third drivers. Here, the first to third drivers selectively drive a corresponding one of the α-analog data, the β-analog data and the γ-analog data to generate first to third driving outputs, and the first to third drivers drive different analog data in first and second driving operations to generate the first to third driving outputs.

A source driver circuit in accordance with the principles of the invention may be driven using separately provided R, G, and B-group gradation voltages to provide source voltages as R, G, and B image signals to data lines of the display panel.

In this disclosure, an identifier α, β or γ is added before group gradation voltages, digital data, and analog data to indicate an association with R, G, and B image signals. That is, the identifier α indicates any one of R, G and B, the identifier β indicates another of R, G and B, and γ indicates the other of R, G, and B. Thus, it can be seen that group gradation voltages, digital data and analog data having the same identifier are intended to generate the same image signal.

Meanwhile, the source driver circuit of the present invention may perform multiple driving operations within a unit sourcing period. In this disclosure, the unit sourcing period refers to a timing period in which the respective source voltages are provided once to all the data lines in the display panel.

The driving operations may be referred to as a first driving operation, a second driving operation, a third driving operation, and so on according to an order of performing the operations. Also, the same names and reference numbers of signals and data may be used irrespective of the first driving operation, the second driving operation and the third driving operation.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain aspects of the invention.

FIG. 5 is a diagram for explaining contents of each driving output in the source driver circuit of FIG. 4;

FIG. 7 is a diagram for explaining image signals provided to first to sixth data lines in the source driver circuit of FIG. 4.

FIG. 9 is a diagram for explaining contents of each driving output in the source driver circuit of FIG. 8;

FIG. 11 is a diagram for explaining image signals provided to first to sixth data lines in the source driver circuit of FIG. 8.

DETAILED DESCRIPTION OF EMBODIMENTS

Figure 1:
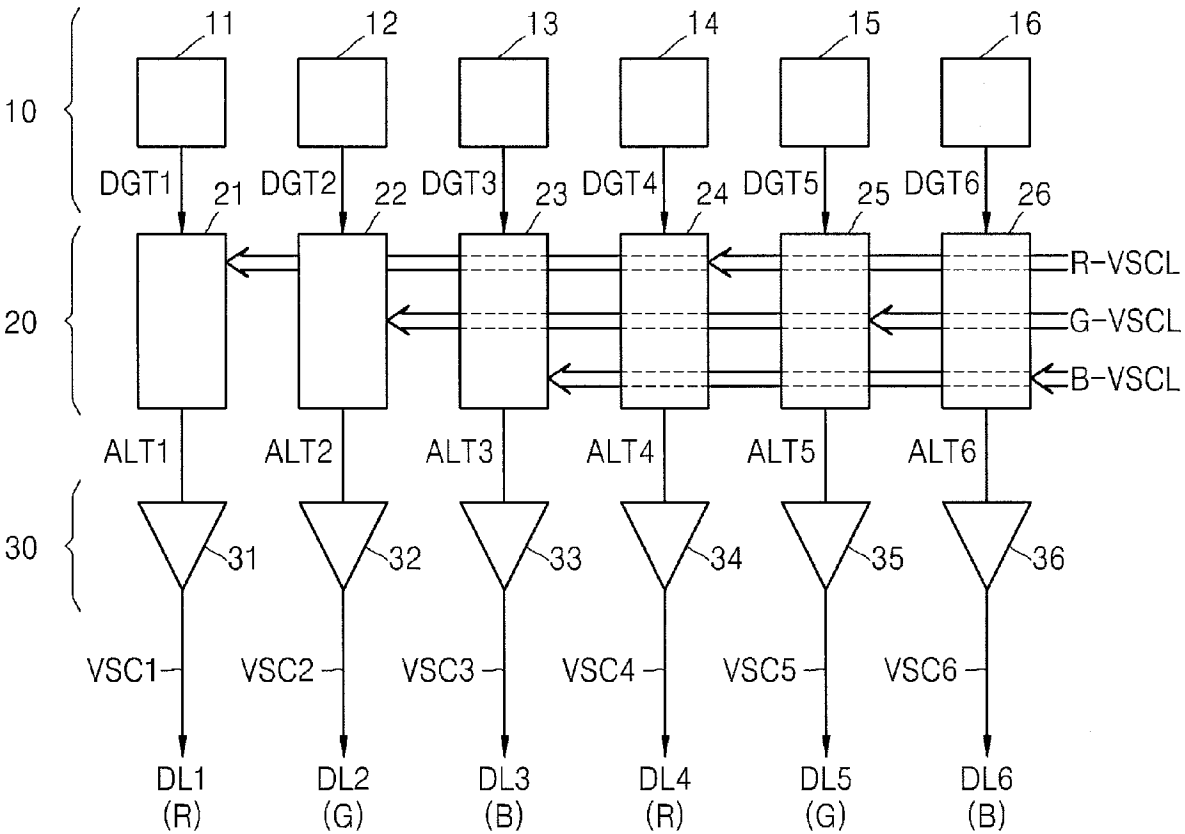
FIG. 1 ( Prior Art )
FIG. 1 is a block diagram of a source driver circuit in a conventional flat panel display device using separately provided R, G, and B-group gradation voltages.
Figure 2:
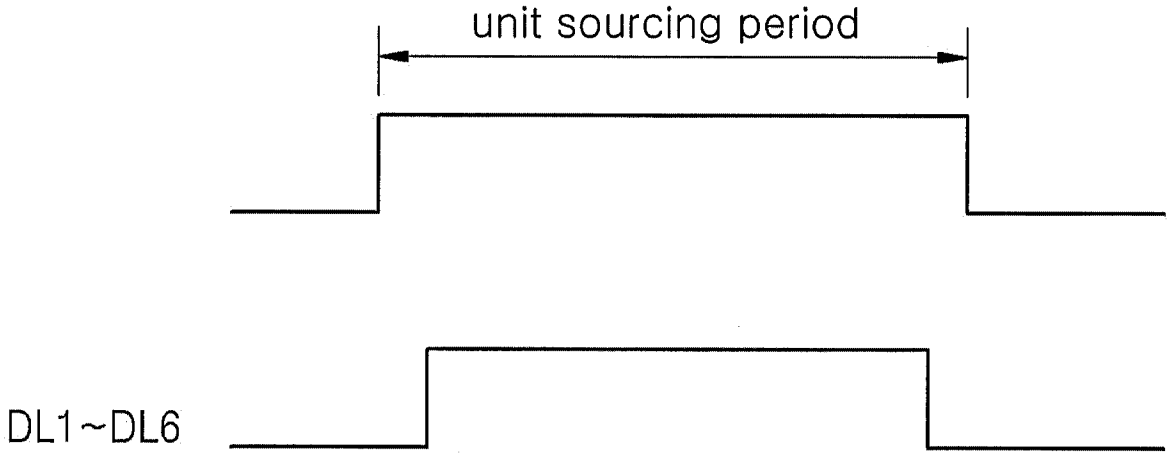
FIG. 2 (Prior Art)
FIG. 2 is a diagram for explaining timing when source voltages are applied to data lines in the source driver circuit of FIG. 1.

The foregoing and other objects, features, and advantages of the invention are apparent from the following detailed description taken in conjunction with the accompanying drawings Hereinafter, exemplary embodiments of the present invention will be described with reference to the accompanying drawings. In the drawings, like elements are designated by like reference numerals, and the detailed description of known functions and constructions considered to make the subject matter of the present invention unnecessarily ambiguous will be omitted. Devices or circuit elements described as being coupled with each other should be interpreted as being directly or indirectly coupled with each other, such that data or signals may be directly communicated between the devices or indirectly communicated through one or more other devices.

Flat Panel Display Device

Figure 3:
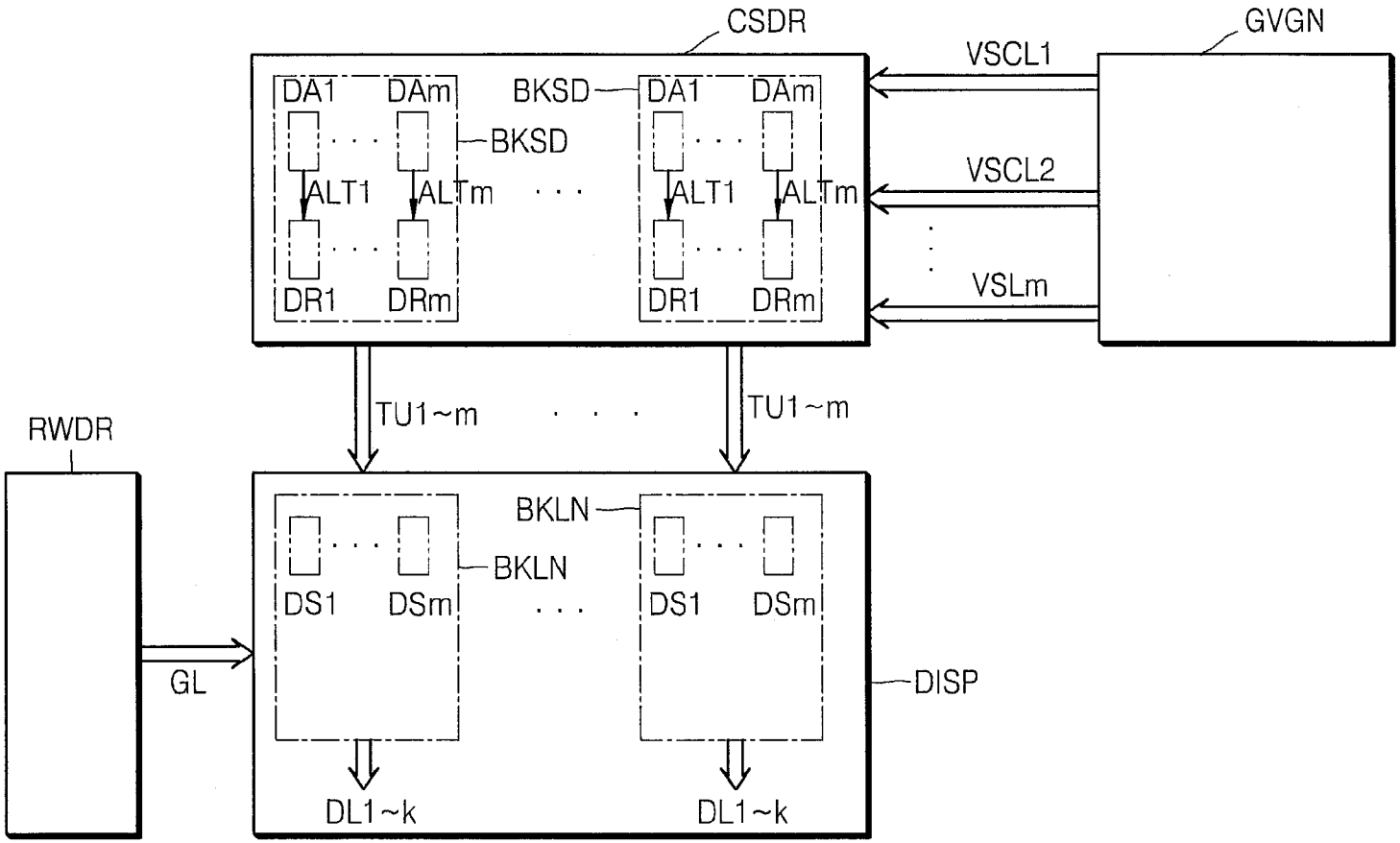
FIG. 3 is a block diagram of a flat panel display device according to an exemplary embodiment of the present invention.

FIG. 3 is a block diagram of a flat panel display device according to an exemplary embodiment of the present invention. Referring to FIG. 3, a flat panel display device of the present invention includes a display panel DISP, a gate driver circuit RWDR, a gamma voltage generation circuit GVGN, and a source driver circuit CSDR.

The display panel DISP includes a plurality of pixels (not shown) arranged in a matrix structure consisting of rows and columns. The display panel DISP further includes a plurality of line groups BKLN each having first to K-th data lines DL1 to DLk and first to M-th supply selectors DS1 to DSm sequentially disposed on columns of the matrix structure. Here, K=M×N, and M and N are natural numbers greater than or equal to 2. The i-supply selector DSi selectively provides an i-th driving output TUi to the j-th to (j−1+N)-th data lines DLj to DL(j−1+n). Here, j=(i−1)×N+1.

The gate driver circuit RWDR drives the gate lines GL arranged on rows of the matrix structure.

The gamma voltage generation circuit GVGN generates first to M-th group gradation voltages VSCL1 to VSCLm and provides the first to M-th group gradation voltages VSCL1 to VSCLm to the source driver circuit CSDR.

The source driver circuit CSDR includes a plurality of source driving blocks BKSD. Each of the source driving blocks BKSD includes first to M-th DACs DA1 to DAm and first to M-th drivers DR1 to DRm, and corresponds to one line group BKLN including the K data lines DL. Each source driving block BKSD provides K driving outputs to the corresponding line groups BKLN in one unit sourcing period.

The first to M-th DACs DA1 to DAm output first to M-th analog data ALT1 to ALTm according to the group gradation voltages in first to N-th driving operations within (or during) one unit sourcing period.

The first to M-th drivers DR1 to DRm receive the first to M-th analog data ALT1 to ALTm in common in the first to N-th driving operations and selectively drive corresponding analog data of the received first to M-th analog data ALT1 to ALTm to generate the first to M-th driving outputs TU1 to TUm. The analog data driven by the i-th driver (where 1≤i≤M) is received by the i-th driver from a different DAC in each of the N driving operations. For example, the first driver may receive an analog data input signal from the first DAC during the first driving operation and from the third DAC during the second driving operation, while the second driver may receive an analog data input signal from the second DAC during the first driving operation and from the first DAC during the second driving operation.

Preferably, the gate driver circuit RWDR drives the gate lines GL different from each other in the first to N-th driving operations.

A configuration and operation of the display panel DISP and the source driver circuit BKSD will now be described in greater detail.

Source Driver Circuit in First Exemplary Embodiment

Figure 4:
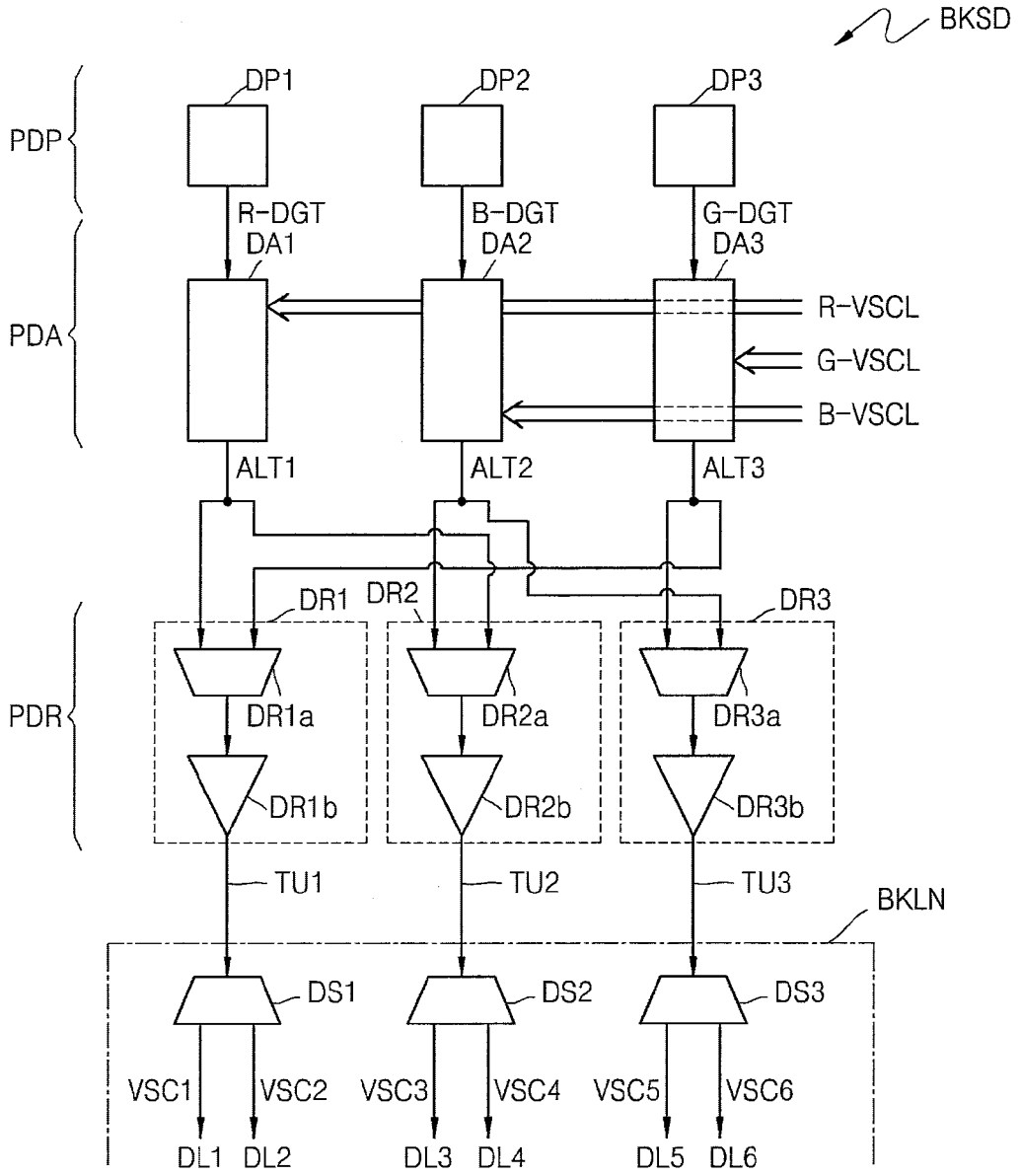
FIG. 4 is a diagram for explaining a source driver circuit according to a first exemplary embodiment of the present invention.

FIG. 4 illustrates a source driver circuit that is applicable to the flat panel display device of FIG. 3 and a related portion of the display panel as a diagram for explaining a source driver circuit according to a first exemplary embodiment of the present invention. One source driving block BKSD included in the source driver circuit of the present invention and one line block BKLN included in the display panel are shown in FIG. 4. However, the source driver circuit of the present invention includes a plurality of source driving blocks BKSD, and the display panel includes a plurality of line blocks BKLN, as described above.

The exemplary embodiment of FIG. 4 may be applied to the flat panel display device of FIG. 3, in which M is 3 and N is 2. That is, three group gradation voltages, i.e., α-group gradation voltages R-VSCL, β-group gradation voltages B-VSCL, and γ-group gradation voltages G-VSCL are provided. Also, two driving operations, i.e., a first driving operation P-FDR and a second driving operation P-SDR are sequentially performed within (or during) one unit sourcing period (see FIG. 6). Also, the line block BKLN of the display panel corresponding to one source driving block BKSD of the source driver circuit of FIG. 4 includes first to sixth data lines DL1 to DL6 that are sequentially disposed.

Meanwhile, in the exemplary embodiment of FIG. 4, an identifier a is associated with an image signal R, β is associated with an image signal B, and γ is associated with an image signal G. Accordingly, R, B, and G may be shown and described in place of the identifiers α, β, and γ for the signals, the voltages and the data in FIG. 4.

Referring back to FIG. 4, the source driving block BKSD in the source driver circuit of the present invention includes a data supply unit PDP, a digital-to-analog conversion unit PDA, and a driving unit PDR.

The data supply unit PDP respectively supplies α-digital data R-DGT, β-digital data B-DGT and γ-digital data G-DGT through registers DP1, DP2, and DP3 in the first and second driving operations P-FDR and P-SDR. The α-digital data R-DGT, the β-digital data B-DGT and the γ-digital data G-DGT provided through the registers DP1, DP2, and DP3 may have different bit values in the first and second driving operations P-FDR and P-SDR.

In this disclosure, the α-digital data R-DGT, the β-digital data B-DGT and the γ-digital data G-DGT are shown and described as being provided through the same registers DP1, DP2, and DP3 in the first and second driving operations P-FDR and P-SDR. However, it will be apparent to those skilled in the art that the α-digital data R-DGT, the β-digital data B-DGT and the γ-digital data G-DGT may be provided through separately configured registers in the first and second driving operations P-FDR and P-SDR. For example, the R-DGT, B-DGT, and G-DGT signals may respectively be provided from the DP1, DP2, and DP3 registers during the first driving operation P-FDR, and provided from other registers (not shown) respectively coupled to the inputs of the DACs DA1, DA2, and DA3 during the second driving operation P-SDR.

The digital-to-analog conversion unit PDA includes first to third DACs DA1, DA2, and DA3. The α-group gradation voltages R-VSCL are provided at an input of the first DAC DA1 from the GVGN. The first DAC DA1 has an input coupled to the first register DP1, and receives the α-digital data R-DGT from the first register DP1 of the data supply unit PDP and generates α-analog data R-ALT in the first and second driving operations P-FDR and P-SDR. In this case, the α-analog data R-ALT has any one of the α-group gradation voltages R-VSCL corresponding to the a-digital data R-DGT.

The β-group gradation voltages B-VSCL are provided at an input of the second DAC DA2 from the GVGN. The second DAC DA2 has an input coupled to the second register DP2, and receives the β-digital data B-DGT from the second register DP2 of the data supply unit PDP and generates β-analog data B-ALT in the first and second driving operations P-FDR and P-SDR. In this case, the β-analog data B-ALT has any one of the β-group gradation voltages B-VSCL corresponding to the β-digital data B-DGT.

The γ-group gradation voltages G-VSCL are provided at an input of the third DAC

DA3 from the GVGN. The third DAC DA3 has an input coupled to the third register DP3, and receives the γ-digital data G-DGT from the third register DP3 of the data supply unit PDP and generates γ-analog data G-ALT in the first and second driving operations P-FDR and P-SDR. In this case, the γ-analog data G-ALT has any one of the γ-group gradation voltages G-VSCL corresponding to the γ-digital data G-DGT.

The driving unit PDR includes first to third drivers DR1 to DR3. The first to third drivers DR1 to DR3 selectively drive a corresponding one of the α-analog data R-ALT, the β-analog data B-ALT and the γ-analog data G-ALT to generate first to third driving outputs TU1 to TU3, respectively. The first to third drivers DR1 to DR3 also drive different analog data to generate the first to third driving outputs TU1 to TU3 in the first and second driving operations P-FDR and P-SDR.

Specifically in the exemplary embodiment shown in FIG. 4, the first driver DR1 is coupled to outputs of the first and third DACs and is configured to selectively drive any one of the α-analog data R-ALT received from the first DAC and the γ-analog data G-ALT received from the third DAC to generate the first driving output TU1 at its output.

According to the exemplary embodiment shown in FIG. 4, the first driver DR1 includes a first driving selector DR1*a* and a first amplifier DR1*b*. The first driving selector DR1*a* selectively outputs any one of the α-analog data R-ALT and the γ-analog data G-ALT. In the present exemplary embodiment, the first driving selector DR1*a* selects and outputs the α-analog data R-ALT in the first driving operation P-FDR and the γ-analog data G-ALT in the second driving operation P-SDR. The first amplifier DR1*b* amplifies the output of the first driving selector DR1*a* to generate the first driving output TU1.

In the exemplary embodiment of FIG. 4, the second driver DR2 is coupled to outputs of the second and first DACs and is configured to selectively drive any one of the β-analog data B-ALT received from the second DAC and the α-analog data R-ALT received from the first DAC to generate the second driving output TU2.

According to the exemplary embodiment, the second driver DR2 includes a second driving selector DR2*a* and a second amplifier DR2*b*. The second driving selector DR2*a* selectively outputs any one of the β-analog data B-ALT and the α-analog data R-ALT. In the present exemplary embodiment, the second driving selector DR2*a* selects and outputs the β-analog data B-ALT in the first driving operation P-FDR and the α-analog data R-ALT in the second driving operation P-SDR. The second amplifier DR2*b* amplifies the output of the second driving selector DR2*a* to generate the second driving output TU2.

In the exemplary embodiment of FIG. 4, the third driver DR3 is coupled to outputs of the third and second DACs and is configured to selectively drive any one of the γ-analog data G-ALT received from the third DAC and the β-analog data B-ALT received from the second DAC to generate the third driving output TU3.

According to the exemplary embodiment, the third driver DR3 includes a third driving selector DR3*a* and a third amplifier DR3*b*. The third driving selector DR3*a* selectively outputs any one of the γ-analog data G-ALT and the β-analog data B-ALT. In the present exemplary embodiment, the third driving selector DR3*a* selects and outputs the γ-analog data G-ALT in the first driving operation P-FDR and the β-analog data B-ALT in the second driving operation P-SDR. The third amplifier DR3*b* amplifies the output of the third driving selector DR3*a* to generate the third driving output TU3.

As a result, in the present exemplary embodiment, the first driver DR1 selectively drives the α-analog data R-ALT to generate the first driving output TU1 in the first driving operation P-FDR and selectively drives the γ-analog data G-ALT to generate the first driving output TU1 in the second driving operation P-SDR.

The second driver DR2 selectively drives the β-analog data B-ALT to generate the second driving output TU2 in the first driving operation P-FDR, and selectively drives the α-analog data R-ALT to generate the second driving output TU2 in the second driving operation P-SDR.

The third driver DR3 selectively drives the γ-analog data G-ALT to generate the third driving output TU3 in the first driving operation P-FDR, and selectively drives the β-analog data B-ALT to generate the third driving output TU3 in the second driving operation P-SDR.

The first to third driving outputs TU1 to TU3 in the first and second driving operations P-FDR and P-SDR will now be summarized with reference to FIG. 5.

The first, second and third driving outputs TU1, TU2, and TU3 in the first driving operation P-FDR depend on the R, B, and G group gradation voltages, respectively. The first, second and third driving outputs TU1, TU2, and TU3 in the second driving operation P-SDR depend on the G, R, and B group gradation voltages, respectively.

Meanwhile, the line block BKLN of the display panel DISP corresponding to the source driver circuit according to a first exemplary embodiment of the present invention has first to sixth data lines DL1 to DL6 and first to third supply selectors DS1 to DS3 sequentially disposed on columns of the matrix structure.

The first supply selector DS1 selectively provides the first driving output TU1 to the first and second data lines DL1 and DL2. In the present exemplary embodiment, the first supply selector DS1 is coupled to the output of the first driver DR1 and provides the first driving output TU1 to the first data line DL1 in the first driving operation P-FDR and to the second data line DL2 in the second driving operation P-SDR.

The second supply selector DS2 selectively provides the second driving output TU2 to the third and fourth data lines DL3 to DL4. In the present exemplary embodiment, the second supply selector DS2 is coupled to the output of the second driver DR2 and provides the second driving output TU2 to the third data line DL3 in the first driving operation P-FDR and to the fourth data line DL4 in the second driving operation P-SDR.

The third supply selector DS3 selectively provides the third driving output TU3 to the fifth and sixth data lines DL5 to DL6. In the present exemplary embodiment, the third supply selector DS3 is coupled to the output of the third driver DR3 and provides the third driving output TU3 to the fifth data line DL5 in the first driving operation P-FDR and to the sixth data line DL6 in the second driving operation P-SDR.

Figure 6:
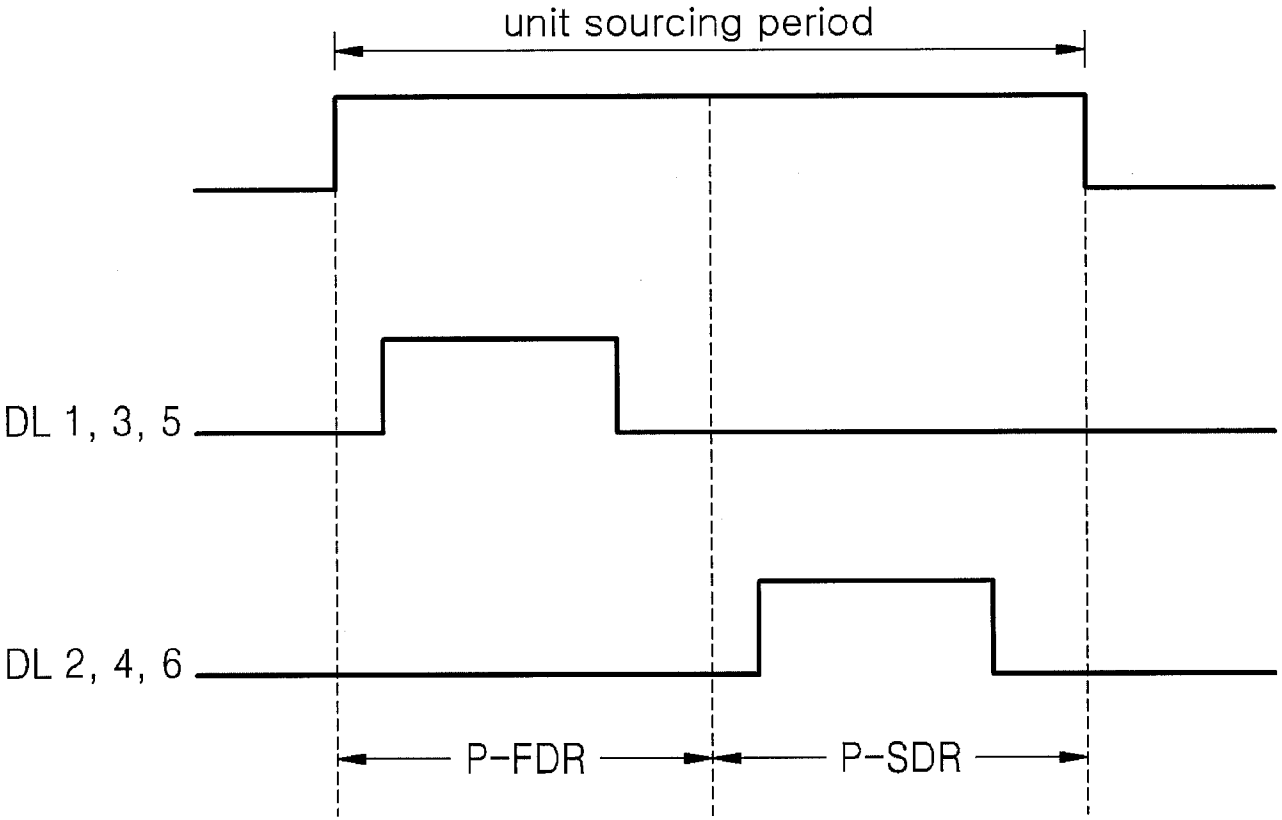
FIG. 6 is a diagram for explaining timing when source voltages are applied to data lines in the source driver circuit of FIG. 4.

In summary, it is to be noted that in the flat panel display device including the source driver circuit according to a first exemplary embodiment of the present invention shown in FIG. 4, the source voltages are provided to three of the six data lines DL1 to DL6 in the first driving operations P-FDR and the other three in the second driving operation P-SDR, as shown in FIG. 6. In other words, the first, third and fifth data lines DL1, DL3, and DL5 are selected in the first driving operation P-FDR, and the second, fourth and sixth data lines DL2, DL4, and DL6 are selected in the second driving operation P-SDR.

Preferably, different ones of the gate lines GL (not shown in FIG. 4) are selected and driven in the first and second driving operations P-FDR and P-SDR. This is intended to minimize a coupling noise of the data lines DL that may be generated when the same gate line GL is selected in the first and second driving operations P-FDR and P-SDR.

FIG. 7 is a diagram for explaining image signals provided to the first to sixth data lines DL1 to DL6 through the first and second driving operations P-FDR and P-SDR in the source driver circuit and the related circuit of FIG. 4. As shown in FIG. 7, a source voltage of the image signal R is provided to the first and fourth data lines DL1 and DL4, a source voltage of the image signal G is provided to the second and fifth data lines DL2 and DL5, and a source voltage of the image signal B is provided to the third and sixth data lines DL3 and DL6.

It will be apparent to those skilled in the art that the data lines to which the source voltages are provided in the first and second driving operations P-FDR and P-SDR may vary from the source driver circuit and the related circuit in the first exemplary embodiment.

Meanwhile, although the supply selectors DS1 to DS3 are shown and described as being disposed in the display panel of FIG. 4, it will be apparent to those skilled in the art that the supply selectors DS1 to DS3 may be disposed in the source driver circuit rather than the display panel to achieve the same effect of the present invention.

In the first exemplary embodiment, only one DAC may be needed in the source driver circuit for every two data lines of the display panel, resulting in a net 50% reduction in the number of DACs needed to drive the display panel. Similarly, only one driver DR1*b*-DR3*b* may be needed in the source driver circuit for every two data lines DL1-DL6 of the display panel, resulting in a 50% reduction in the number of drivers needed to drive the display panel. Thus, an overall layout area can be greatly reduced in a flat panel display device employing the source driver circuit of the first exemplary embodiment, unlike conventional technology.

The first exemplary embodiment can be expanded to the second exemplary embodiment.

Source Driver Circuit in Second Exemplary Embodiment

Figure 8:
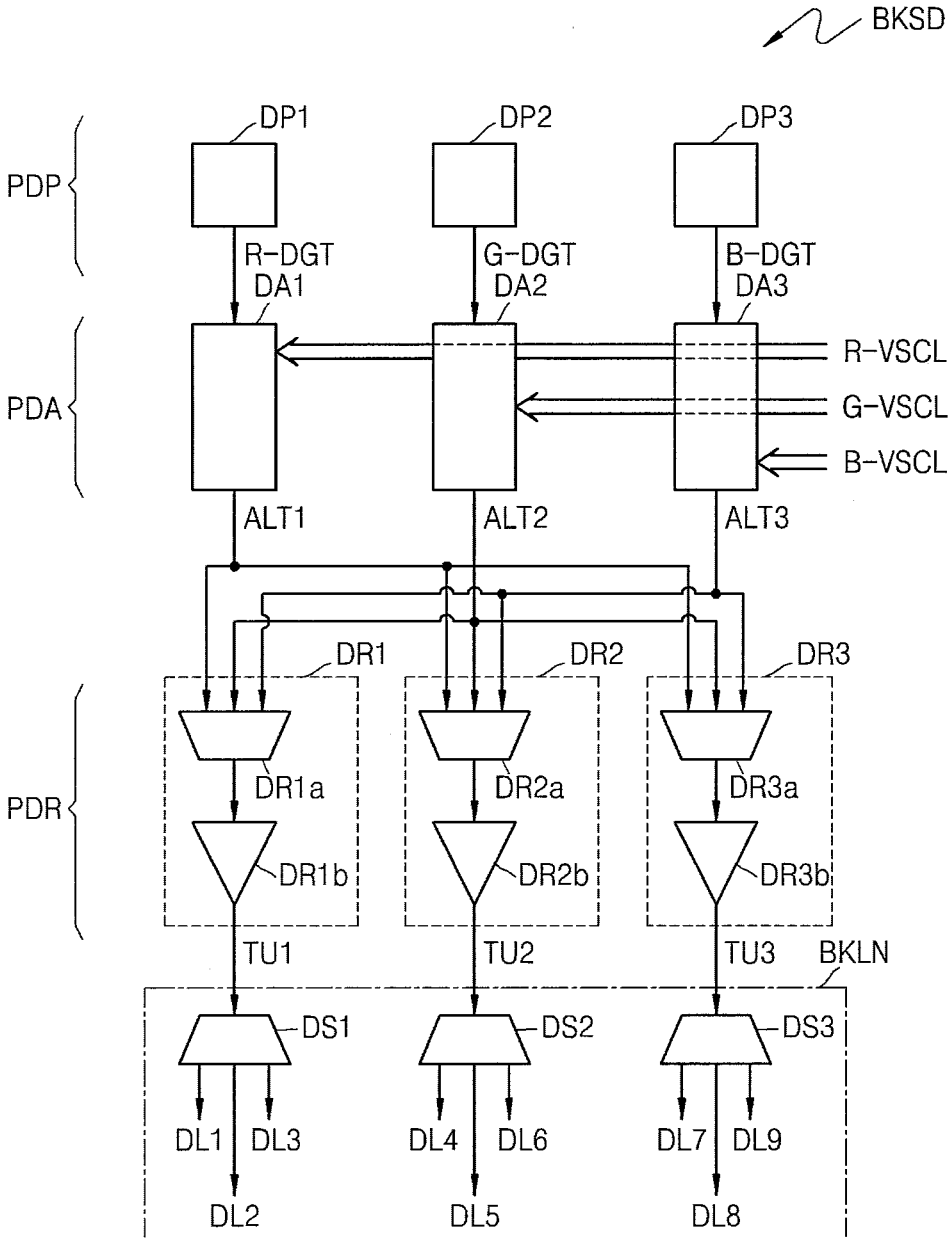
FIG. 8 is a diagram for explaining a source driver circuit according to a second exemplary embodiment of the present invention.

FIG. 8 illustrates a source driver circuit that is applicable to the flat panel display device of FIG. 3 and a related portion of the display panel as a diagram for explaining a source driver circuit according to a second exemplary embodiment of the present invention. One source driving block BKSD included in the source driver circuit of the present invention and one line block BKLN included in the display panel are shown in FIG. 8. However, the source driver circuit of the present invention includes a plurality of source driving blocks BKSD, and the display panel includes a plurality of line blocks BKLN, as described above.

The exemplary embodiment of FIG. 8 may be applied to the flat panel display device of FIG. 3, in which M is 3 and N is 3. That is, three group gradation voltages, i.e., α-group gradation voltages R-VSCL, β-group gradation voltages B-VSCL, and γ-group gradation voltages G-VSCL are provided. Also, three driving operations, i.e., a first driving operation P-FDR, a second driving operation P-SDR and a third driving operation P-TDR are sequentially performed within one unit sourcing period (see FIG. 10). Also, the line block BKLN of the display panel corresponding to one source driving block BKSD of the source driver circuit of FIG. 8 includes first to ninth data lines DL1 to DL9 that are sequentially disposed.

Meanwhile, in the exemplary embodiment of FIG. 8, an identifier αis associated with an image signal R, β is associated with an image signal G, and γis associated with an image signal B. Accordingly, R, G, and B may be shown and described in place of the identifiers α, β, and γ for the signals, the voltages and the data in FIG. 8.

Referring back to FIG. 8, the source driving block BKSD in the source driver circuit of the present invention includes a data supply unit PDP, a digital-to-analog conversion unit PDA, and a driving unit PDR.

The data supply unit PDP supplies α-digital data R-DGT, β-digital data B-DGT and γ-digital data G-DGT through registers DP1, DP2, and DP3 in the first, second and third driving operations P-FDR, P-SDR and P-TDR. The α-digital data R-DGT, the β-digital data G-DGT and the γ-digital data B-DGT provided through the registers DP1, DP2, and DP3 may have different bit values in the first, second, third driving operations P-FDR, P-SDR and P-TDR.

In this disclosure, the α-digital data R-DGT, the β-digital data G-DGT and the γ-digital data B-DGT are shown and described as being provided through the same registers DP1, DP2, and DP3 in the first, and third driving operations P-FDR, P-SDR and P-TDR. However, it will be apparent to those skilled in the art that the α-digital data R-DGT, the β-digital data G-DGT and the γ-digital data B-DGT may be provided through separately configured registers in the first, second and third driving operations P-FDR, P-SDR and P-TDR. As such, each of the DACs DA1, DA2, and DA3 may have inputs coupled to more than one register in order to receive input data from separately configured registers in the first, second, and third driving operations P-FDR, P-SDR, and P-TDR.

The digital-to-analog conversion unit PDA includes first to third DACs DA1, DA2, and DA3. In the exemplary embodiment shown in FIG. 8, the α-group gradation voltages R-VSCL are provided to the first DAC DA1. The first DAC DA1 may receive the α-digital data R-DGT from the first register DP1 of the data supply unit PDP and generate α-analog data R-ALT in each of the first, second and the driving operations P-FDR, P-SDR and P-TDR. In this case, the α-analog data R-ALT may have any one of the α-group gradation voltages R-VSCL corresponding to the α-digital data R-DGT.

The β-group gradation voltages G-VSCL may be provided to the second DAC DA2. The second DAC DA2 may receive the β-digital data G-DGT from the second register DP2 of the data supply unit PDP and generate β-analog data G-ALT in each of the first, second and the driving operations P-FDR, P-SDR and P-TDR. In this case, the β-analog data G-ALT may have any one of the β-group gradation voltages G-VSCL corresponding to the β-digital data G-DGT.

The γ-group gradation voltages V-VSCL may be provided to the third DAC DA3. The third DAC DA3 may receive the γ-digital data B-DGT from the third register DP3 of the data supply unit PDP and generate γ-analog data B-ALT in each of the first, second and the driving operations P-FDR, P-SDR and P-TDR. In this case, the γ-analog data B-ALT may have any one of the γ-group gradation voltages B-VSCL corresponding to the γ-digital data B-DGT.

The driving unit PDR includes first to third drivers DR1 to DR3. The first to third drivers DR1 to DR3 selectively drive a corresponding one of the α-analog data R-ALT, the β-analog data G-ALT and the γ-analog data B-ALT to generate first to third driving outputs TU1 to TU3, respectively. The first to third drivers DR1 to DR3 also drive different analog data to generate the first to third driving outputs TU1 to TU3 in the first, second and third driving operations P-FDR, P-SDR and P-TDR.

According to an exemplary embodiment, the first driver DR1 includes a first driving selector DR1*a* and a first amplifier DR1*b*. The first driving selector DR1*a* selectively outputs any one of the α-analog data R-ALT, the β-analog data G-ALT and the γ-analog data B-ALT. In the present exemplary embodiment, the first driving selector DR1 a selects and outputs the α-analog data R-ALT in the first driving operation P-FDR, the β-analog data G-ALT in the second driving operation P-SD and the γ-analog data B-ALT in the third driving operation P-TDR. The first amplifier DR1*b* amplifies the output of the first driving selector DR1*a* to generate the first driving output TU1.

The second driver DR2 includes a second driving selector DR2*a* and a second amplifier DR2*b*. The second driving selector DR2*a* selectively outputs any one of the α-analog data R-ALT, the β-analog data G-ALT and the γ-analog data B-ALT. In the present exemplary embodiment, the second driving selector DR2*a* selects and outputs the γ-analog data B-ALT in the first driving operation P-FDR, the α-analog data R-ALT in the second driving operation P-SDR and β-analog data G-ALT in the third driving operation P-TDR. The second amplifier DR2*b* amplifies the output of the second driving selector DR2*a* to generate the second driving output TU2.

The third driver DR3 includes a third driving selector DR3*a* and a third amplifier DR3*b*. The third driving selector DR3*a* selectively outputs any one of the α-analog data R-ALT, the β-analog data G-ALT and the γ-analog data B-ALT. In the present exemplary embodiment, the third driving selector DR3*a* selects and outputs the β-analog data G-ALT in the first driving operation P-FDR, the γ-analog data B-ALT in the second driving operation P-SDR and α-analog data R-ALT in the third driving operation P-TDR. The third amplifier DR3*b* amplifies the output of the third driving selector DR3*a* to generate the third driving output TU3.

As a result, in the present exemplary embodiment, the first driver DR1 selectively drives the α-analog data R-ALT in the first driving operation P-FDR, the β-analog data G-ALT in the second driving operation P-SDR and the γ-analog data B-ALT in the third driving operation P-TDR to generate the first driving output TU1.

The second driver DR2 selectively drives the γ-analog data B-ALT in the first driving operation P-FDR, the α-analog data R-ALT in the second driving operation P-SDR and the β-analog data G-ALT in the third driving operation P-TDR to generate the second driving output TU2.

The third driver DR3 selectively drives the β-analog data G-ALT in the first driving operation P-FDR, the γ-analog data B-ALT in the second driving operation P-SDR and the α-analog data R-ALT in the third driving operation P-TDR to generate the third driving output TU3.

The first to third driving outputs TU1 to TU3 in the first to third driving operations P-FDR to P-TDR will now be summarized with reference to FIG. 9.

The first, second and third driving outputs TU1, TU2, and TU3 in the first driving operation P-FDR depend on the R, B, and G group gradation voltages, respectively. The first, second and third driving outputs TU1, TU2, and TU3 in the second driving operation P-SDR depend on the G, R, and B group gradation voltages, respectively. The first, second and third driving outputs TU1, TU2, and TU3 in the third driving operation P-TDR depend on the B, G and R group gradation voltages, respectively.

Meanwhile, the line block BKLN of the display panel DISP corresponding to the source driver circuit according to a second exemplary embodiment of the present invention has first to ninth data lines DL1 to DL9 and first to third supply selectors DS1 to DS3 sequentially disposed on columns of the matrix structure.

The first supply selector DS1 selectively provides the first driving output TU1 to the first, second and third data lines DL1, DL2 and DL3. In the present exemplary embodiment, the first supply selector DS1 provides the first driving output TU1 to the first data line DL1 in the first driving operation P-FDR, the second data line DL2 in the second driving operation P-SDR and the third data line DL3 in the third driving operation P-TDR.

The second supply selector DS2 selectively provides the second driving output TU2 to the fourth to sixth data lines DL4 to DL6. In the present exemplary embodiment, the second supply selector DS2 provides the second driving output TU2 to the sixth data line DL6 in the first driving operation P-FDR, the fourth data line DL4 in the second driving operation P-SDR and the fifth data line DL5 in the third driving operation P-TDR.

The third supply selector DS3 selectively provides the third driving output TU3 to the seventh to ninth data lines DL7 to DL9. In the present exemplary embodiment, the third supply selector DS3 provides the third driving output TU3 to the eighth data line DL8 in the first driving operation P-FDR, the ninth data line DL9 in the second driving operation P-SDR and the seventh data line DL9 in the third driving operation P-TDR.

Figure 10:
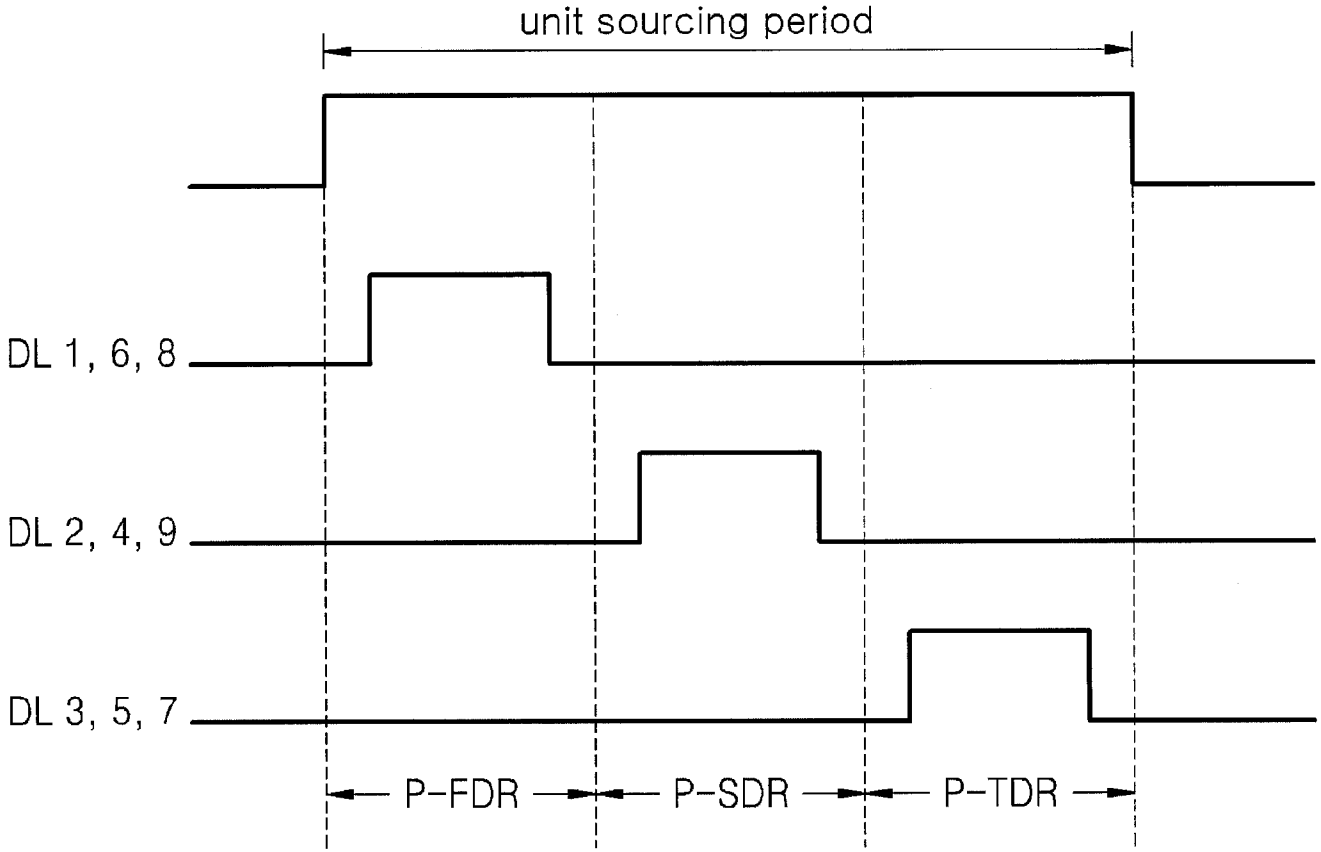
FIG. 10 is a diagram for explaining timing when source voltages are applied to data lines in the source driver circuit of FIG. 8.

In summary, it is to be noted that in the flat panel display device including the source driver circuit according to a second exemplary embodiment of the present invention, the source voltages are provided to three of the nine data lines DL1 to DL9 in each of the first to third driving operations P-FDR to P-TDR, as shown in FIG. 10. In other words, the first, sixth and eighth data lines DL1, DL6, and DL8 are selected in the first driving operation P-FDR. The second, fourth and ninth data lines DL2, DL4, and DL9 are selected in the second driving operation P-SDR, and the third, fifth and seventh data lines DL3, DL5, and DL7 are selected in the third driving operation P-TDR.

Preferably, different ones of the gate lines GL (not shown in FIG. 8) are selected and driven in the first, second and third driving operations P-FDR, P-SDR and P-TDR. This is intended to minimize a coupling noise of the data lines DL that may be generated when the same gate line GL is selected in the first, second and third driving operations P-FDR, P-SDR and P-TDR.

FIG. 11 is a diagram for explaining image signals provided to the first to ninth data lines DL1 to DL9 through the first, second and third driving operations P-FDR, P-SDR and P-TDR in the source driver circuit and the related circuit of FIG. 8. As shown in FIG. 11, a source voltage of the image signal R is provided to the first, fourth and seventh data lines DL1, DL4 and DL7, a source voltage of the image signal G is provided to the second, fifth and eighth data lines DL2, DL5 and DL8, and a source voltage of the image signal B is provided to the third, sixth and ninth data lines DL3, DL6 and DL9.

It will be apparent to those skilled in the art that the data lines to which the source voltages are provided in the first, second and third driving operations P-FDR, P-SDR and P-TDR may vary from the source driver circuit and the related circuit in the second exemplary embodiment.

Meanwhile, although the supply selectors DS1 to DS3 are shown and described as being disposed in the display panel of FIG. 8, it will be apparent to those skilled in the art that the supply selectors DS1 to DS3 may be disposed in the source driver circuit rather than the display panel to achieve the same effect of the present invention.

In the second exemplary embodiment, only one DAC may be needed in the source driver circuit for every three data lines of the display panel, resulting in a net 66% reduction in the number of DACs needed to drive the display panel. Thus, an overall layout area can be greatly reduced in a flat panel display device employing the source driver circuit of the second exemplary embodiment, unlike conventional technology.

In a flat panel display device of the present invention, multiple driving operations are performed within a unit sourcing period, and source voltages are supplied to some of the data lines of a display panel in each driving operation. In this case, one DAC is driven to generate source voltages for a plurality of data lines. That is, the number of the DACs disposed on each data line is reduced to 1/N. Therefore, with the source driver circuit of the present invention, the number of the DACs is reduced and the overall layout area is greatly reduced.

Also, standby power consumption can be greatly reduced due to the reduced number of amplifiers on each data line in the flat panel display device of the present invention, unlike the conventional technology.

According to the flat panel display device of the present invention, since the source voltages provided by the same amplifier are provided to adjacent data lines, a metal layer can be easily wired in the display panel.

Although three R, G and B group gradation voltages have been used in the exemplary embodiments, it will be apparent to those skilled in the art that four or more group gradation voltages, such as R, G, B and W, may be used.

Also, although two to three driving operations have been performed in the unit sourcing period according to the exemplary embodiments, it will be apparent to those skilled in the art that four or more driving operations may be performed in the unit sourcing period.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A source driver circuit for a flat panel display device, wherein the flat panel display device also comprises a display panel, a first supply selector, a second supply selector, and a third supply selector, and wherein the source driver circuit comprises a plurality of source driving blocks, each of the source driving blocks comprising:

a data supply unit supplying α-digital data, β-digital data, and γ-digital data;

a digital-to-analog conversion unit comprising a first digital-to-analog converter (DAC) which receives α-group gradation voltages, a second DAC which receives β-group gradation voltages, and a third DAC which receives γ-group gradation voltages, the first, second, and third DACs respectively receiving the α-digital data, the β-digital data, and the γ-digital data from the data supply unit and respectively outputting α-analog data, β-analog data, and γ-analog data having the α-group gradation voltage, the β-group gradation voltage, and the γ-group gradation voltage corresponding to the α-digital data, the β-digital data, and the γ-digital data; and a driving unit comprising first, second, and third drivers, wherein the first, second, and third drivers selectively drive a corresponding one of the α-analog data, the β-analog data, and the γ-analog data received from the first, second, and third DACs to generate first, second, and third driving outputs, wherein the first, second, and third drivers drive different analog data in first and second driving operations to generate the first, second, and third driving outputs, wherein the first driver and the second driver both receive the same α-analog data from the first DAC during the first driving operation, wherein the first driver drives the α-analog data received from the first DAC as the first driving output during the first driving operation and drives the γ-analog data received from the third DAC as the first driving output during the second driving operation, wherein the second driver drives the β-analog data received from the second DAC as the second driving output during the first driving operation and drives the α-analog data received from the first DAC as the second driving output during the second driving operation, wherein the third driver drives the γ-analog data received from the third DAC as the third driving output during the first driving operation and drives the β-analog data received from the second DAC as the third driving output during the second driving operation, wherein the first driver outputs the first driving output to the first supply selector, and wherein the first supply selector outputs the first driving output to a first data line of the display panel during the first driving operation and outputs the first driving output to a second data line of the display panel during the second driving operation, wherein the second driver outputs the second driving output to the second supply selector, and wherein the second supply selector outputs the second driving output to a third data line of the display panel during the first driving operation and outputs the second driving output to a fourth data line of the display panel during the second driving operation, and wherein the third driver outputs the third driving output to the third supply selector, and wherein the third supply selector outputs the third driving output to a fifth data line of the display panel during the first driving operation and outputs the third driving output to a sixth data line of the display panel during the second driving operation.

2. The circuit of claim 1, wherein the first and second driving operations are sequentially performed within one unit sourcing period.

3. The circuit of claim 1, wherein the first driver comprises:

a first driving selector having inputs coupled to outputs of the first and third DACs, the first driving selector selectively outputting any one of the α-analog data and the γ-analog data at an output; and a first amplifier coupled to the output of the first driving selector, the first amplifier amplifying the output of the first driving selector to generate the first driving output, wherein the second driver comprises:

a second driving selector having inputs coupled to outputs of the second and first DACs, the second driving selector selectively outputting any one of the β-analog data and the α-analog data at an output; and a second amplifier coupled to the output of the second driving selector, the second amplifier amplifying the output of the second driving selector to generate the second driving output, and wherein the third driver comprises:

a third driving selector having inputs coupled to outputs of the third and second DACs, the third driving selector selectively outputting any one of the γ-analog data and the β-analog data at an output; and a third amplifier coupled to the output of the third driving selector, the third amplifier amplifying the output of the third driving selector to generate the third driving output.

4. The circuit of claim 1, wherein the α-group gradation voltages are R-group gradation voltages, the β-group gradation voltages are B-group gradation voltages, and the γ-group gradation voltages are G-group gradation voltages.

5. A source driver circuit for a flat panel display device, wherein the flat panel display device also comprises a display panel, a first supply selector, a second supply selector, and a third supply selector, and wherein the source driver circuit comprises a plurality of source driving blocks, each of the source driving blocks comprising:

a data supply unit supplying first α-digital data, first β-digital data, and first γ-digital data in a first driving operation and second α-digital data, second β-digital data, and second γ-digital data in a second driving operation;

a digital-to-analog conversion unit comprising a first DAC which receives α-group gradation voltages, a second DAC which receives β-group gradation voltages, and a third DAC which receives γ-group gradation voltages, wherein the first, second, and third DACs respectively receive the first α-digital data, the first β-digital data, and the first γ-digital data and respectively output first a-analog data, first β-analog data, and first γ-analog data based on the α-group gradation voltage, the β-group gradation voltage, and the γ-group gradation voltage corresponding to the first α-digital data, the first β-digital data, and the first γ-digital data in the first driving operation, and wherein the first, second, and third DACs respectively receive the second α-digital data, the second β-digital data, and the second γ-digital data and respectively output second α-analog data, second β-analog data, and second γ-analog data based on the α-group gradation voltage, the β-group gradation voltage, and the γ-group gradation voltage corresponding to the second α-digital data, the second β-digital data, and the second γ-digital data in the second driving operation; and a driving unit comprising first, second, and third drivers, wherein the first driver drives the first α-analog data received from the first DAC to generate a first driving output in the first driving operation and the second γ-analog data received from the third DAC to generate the first driving output in the second driving operation, the second driver drives the first β-analog data received from the second DAC to generate a second driving output in the first driving operation and the second α-analog data received from the first DAC to generate the second driving output in the second driving operation, and the third driver drives the first γ-analog data received from the third DAC to generate a third driving output in the first driving operation and the second β-analog data received from the second DAC to generate the third driving output in the second driving operation, wherein the first driver and the second driver both receive the same first α-analog data from the first DAC during the first driving operation, wherein the first driver outputs the first driving output to the first supply selector, and wherein the first supply selector outputs the first driving output to a first data line of the display panel during the first driving operation and outputs the first driving output to a second data line of the display panel during the second driving operation, wherein the second driver outputs the second driving output to the second supply selector, and wherein the second supply selector outputs the second driving output to a third data line of the display panel during the first driving operation and outputs the second driving output to a fourth data line of the display panel during the second driving operation, and wherein the third driver outputs the third driving output to the third supply selector, and wherein the third supply selector outputs the third driving output to a fifth data line of the display panel during the first driving operation and outputs the third driving output to a sixth data line of the display panel during the second driving operation.

6. The circuit of claim 5, wherein the first and second driving operations are sequentially performed during one unit sourcing period.

7. The circuit of claim 5, wherein the α-group gradation voltages are R-group gradation voltages, the β-group gradation voltages are B-group gradation voltages, and the γ-group gradation voltages are G-group gradation voltages.

8. A source driver circuit for a flat panel display device, wherein the flat panel display device also comprises a display panel, a first supply selector, a second supply selector, and a third supply selector, and wherein the source driver circuit comprises a plurality of source driving blocks, each of the source driving blocks comprising:

a data supply unit supplying α-digital data, β-digital data, and γ-digital data;

a digital-to-analog conversion unit comprising a first digital-to-analog converter (DAC) which receives α-group gradation voltages, a second DAC which receives β-group gradation voltages, and a third DAC which receives γ-group gradation voltages, the first, second, and third DACs receiving the α-digital data, the β-digital data, and the γ-digital data from the data supply unit and outputting α-analog data, β-analog data, and γ-analog data having the α-group gradation voltage, the β-group gradation voltage, and the γ-group gradation voltage corresponding to the α-digital data, the β-digital data, and the γ-digital data; and a driving unit comprising first, second, and third drivers, wherein the first, second, and third drivers selectively drive a corresponding one of the α-analog data, the β-analog data, and the γ-analog data received from the first, second, and third DACs to respectively generate first, second, and third driving outputs, wherein the first, second, and third drivers drive different analog data in each of first, second, and third driving operations to generate the first to third driving outputs, wherein the first driver and the second driver both receive the same α-analog data from the first DAC during the first driving operation, wherein the first driver drives the α-analog data received from the first DAC as the first driving output during the first driving operation, drives the γ-analog data received from the third DAC as the first driving output during the second driving operation, and drives the β-analog data received from the second DAC as the first driving output during the third driving operation, wherein the second driver drives the β-analog data received from the second DAC as the second driving output during the first driving operation, drives the α-analog data received from the first DAC as the second driving output during the second driving operation, and drives the γ-analog data received from the third DAC as the second driving output during the third driving operation, wherein the third driver drives the γ-analog data received from the third DAC as the third driving output during the first driving operation, drives the β-analog data received from the second DAC as the third driving output during the second driving operation, and drives the α-analog data received from the first DAC as the third driving output during the third driving operation, wherein the first driver outputs the first driving output to the first supply selector, and wherein the first supply selector outputs the first driving output to a first data line of the display panel during the first driving operation outputs the first driving output to a second data line of the display panel during the second driving operation, and outputs the first driving output to a third data line of the display panel during the third driving operation, wherein the second driver outputs the second driving output to the second supply selector, and wherein the second supply selector outputs the second driving output to a fourth data line of the display panel during the first driving operation, outputs the second driving output to a fifth data line of the display panel during the second driving operation, and outputs the second driving output to a sixth data line of the display panel during the third driving operation, and wherein the third driver outputs the third driving output to the third supply selector, and wherein the third supply selector outputs the third driving output to a seventh data line of the display panel during the first driving operation, outputs the third driving output to an eighth data line of the display panel during the second driving operation, and outputs the third driving output to a ninth data line of the display panel during the third driving operation.

9. The circuit of claim 8, wherein the first, second, and third driving operations are performed within one unit sourcing period.

10. The circuit of claim 8, wherein the first driver comprises:

a first driving selector selectively outputting any one of the α-analog data, the β-analog data, and the γ-analog data; and a first amplifier amplifying an output of the first driving selector to generate the first driving output, wherein the second driver comprises:

a second driving selector selectively outputting any one of the α-analog data, the β-analog data, and the γ-analog data; and a second amplifier amplifying an output of the second driving selector to generate the second driving output, wherein the third driver comprises:

a third driving selector selectively outputting any one of the α-analog data, the β-analog data, and the γ-analog data; and a third amplifier amplifying an output of the third driving selector to generate the third driving output, and wherein each of the first, second, and third driving selectors have inputs coupled to outputs of the first, second, and third DACs.

11. The circuit of claim 8, wherein the α-group gradation voltages are R-group gradation voltages, the β-group gradation voltages are B-group gradation voltages, and the γ-group gradation voltages are G-group gradation voltages.

12. A source driver circuit for a flat panel display device, wherein the flat panel display device also comprises a display panel and first to M-th supply selectors, and wherein the source driver circuit comprises a plurality of source driving blocks, each of the source driving blocks comprising:

a data supply unit supplying first to M-th digital data (where M is a natural number greater than or equal to 4)

in first to N-th driving operations (where N is a natural number greater than or equal to 2) within one unit sourcing period;

a digital-to-analog conversion unit receiving M group gradation voltages, the digital-to-analog conversion unit comprising first to M-th DACs, and the first to M-th DACs receiving a corresponding one of the gradation voltages and a corresponding one of the digital data and outputting first to M-th analog data signals based on the group gradation voltages corresponding to the received digital data in the first to N-th driving operations; and a driving unit comprising first to M-th drivers generating K driving outputs in the unit sourcing period, wherein $K=M\times N$, and wherein the first to M-th drivers receive the first to M-th analog data signals in common in the first to N-th driving operations and selectively drive a corresponding one of the first to M-th analog data to generate first to M-th driving outputs, and wherein the analog data driven by the i-th driver ($1\leq i\leq M$) is received by the i-th driver from a different DAC of the first to M-th DACs in each of the N driving operations, wherein the first driver and the second driver of the M-th drivers both receive the same α-analog data from the first DAC during the first driving operation, wherein the first driver outputs a first driving output to the first supply selector, and wherein the first supply selector outputs the first driving output to a first data line of the display panel during the first driving operation and outputs the first driving output to a second data line of the display panel during the second driving operation, and wherein the M-th driver outputs the M-th driving output to the M-th supply selector, and wherein the M-th supply selector outputs the M-th driving output to a third data line of the display panel during the first driving operation and outputs the M-th driving output to a fourth data line of the display panel during the second driving operation.

* * * * *